US006354849B1

(12) United States Patent
Jones

(10) Patent No.: US 6,354,849 B1
(45) Date of Patent: Mar. 12, 2002

(54) BOARD-ENGAGING STRUCTURE FOR CONTACTS OF AN ELECTRICAL CONNECTOR

(75) Inventor: Dennis B. Jones, Orange, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/686,448

(22) Filed: Oct. 10, 2000

(51) Int. Cl.[7] ..... H01R 12/00
(52) U.S. Cl. ..... 439/82
(58) Field of Search ..... 439/82, 751

(56) References Cited

U.S. PATENT DOCUMENTS 4,735,575 A * 4/1988 Shaffer ..... 439/82
4,746,301 A * 5/1988 Key ..... 439/82
4,784,620 A * 11/1988 Tanaka ..... 439/82
4,936,797 A * 6/1990 Wehrle et al. ..... 439/82
5,139,446 A * 8/1992 Costello et al. ..... 439/82
5,565,654 A * 10/1996 Zell et al. ..... 439/82
5,667,412 A * 9/1997 Takahashi et al. ..... 439/82

* cited by examiner

*Primary Examiner*—Gary P. Paumen
(74) *Attorney, Agent, or Firm*—Wei Te Chung

(57) ABSTRACT

A contact (1) for an electrical connector includes an elongated body portion (12) and a board-engaging structure (10) extending downward from a lower end of the body portion. The board-engaging structure includes a tail portion (14) which defines a vertical hole (19), enabling each of two sides of the tail portion to elastically deform when the contact is inserted into a hole (32) of a printed circuit board (30). Each of the two sides of the tail portion forms a locking arm (18) curved clockwise around the girth of the tail portion. Each locking arm has a contact surface (18*a*) of an outer limit thereof. Each contact surface is oblique such that an upper portion thereof extends further away from a longitudinal axis of the tail portion than a lower portion thereof does. Thus a considerable contact area is created between each contact surface and an inner wall of the hole in the printed circuit board.

1 Claim, 6 Drawing Sheets

BOARD-ENGAGING STRUCTURE FOR CONTACTS OF AN ELECTRICAL CONNECTOR

FIELD OF THE INVENTION

The present invention relates to a structure for contacts of an electrical connector.

BACKGROUND OF THE INVENTION

Referring to FIG. 6, one board-engaging structure for a conventional contact 60 of an electrical connector is a "press-fit" or "needle-eye" structure. Contacts with this structure require no soldering for connection to a printed circuit board 80. A contact area is created between each bulge portion 62*a* of a tail portion 62 and each inner surface 84 of a hole 82 defined in the printed circuit board 80. However, each contact area is merely point-to-point, and is not sufficiently large to ensure reliable electrical contact. Furthermore, each point-to-point contact area causes the inner surface 84 of the hole 82 to be prone to damage when the tail portion 62 is removed from the PCB 80.

Hence, an improved board-engaging structure for contacts of an electrical connector is required to overcome the disadvantages of the prior art.

BRIEF SUMMARY OF THE INVENTION

An object of the present invention is to provide a board-engaging structure for contacts of an electrical connector wherein the structure has a pair of elastically deformable locking arms which increase the contact area between the structure and a printed circuit board (PCB).

To fulfill the above-mentioned objective, a contact for an electrical connector in accordance with the present invention comprises an elongate body portion and a board-engaging structure extending downward from a lower end of the body portion. The board-engaging structure comprises a tail portion defining a vertical elongated hole in its middle. At each of two lateral sides of the hole, the tail portion forms a locking arm curved clockwise around part of the girth of the tail portion. Each locking arm has a contact surface. Each contact surface is oblique such that an upper portion thereof extends further away from a longitudinal axis of the tail portion than a lower portion thereof does. Thus a considerable contact area is created between each contact surface and an inner wall of a hole in a PCB.

Other objects, advantages and novel features of the invention will become more apparent from the following detailed description of the present embodiment when taken in conjunction with the accompanying drawings.

DETAILED DESCRIPTION OF THE INVENTION

Figure 1:
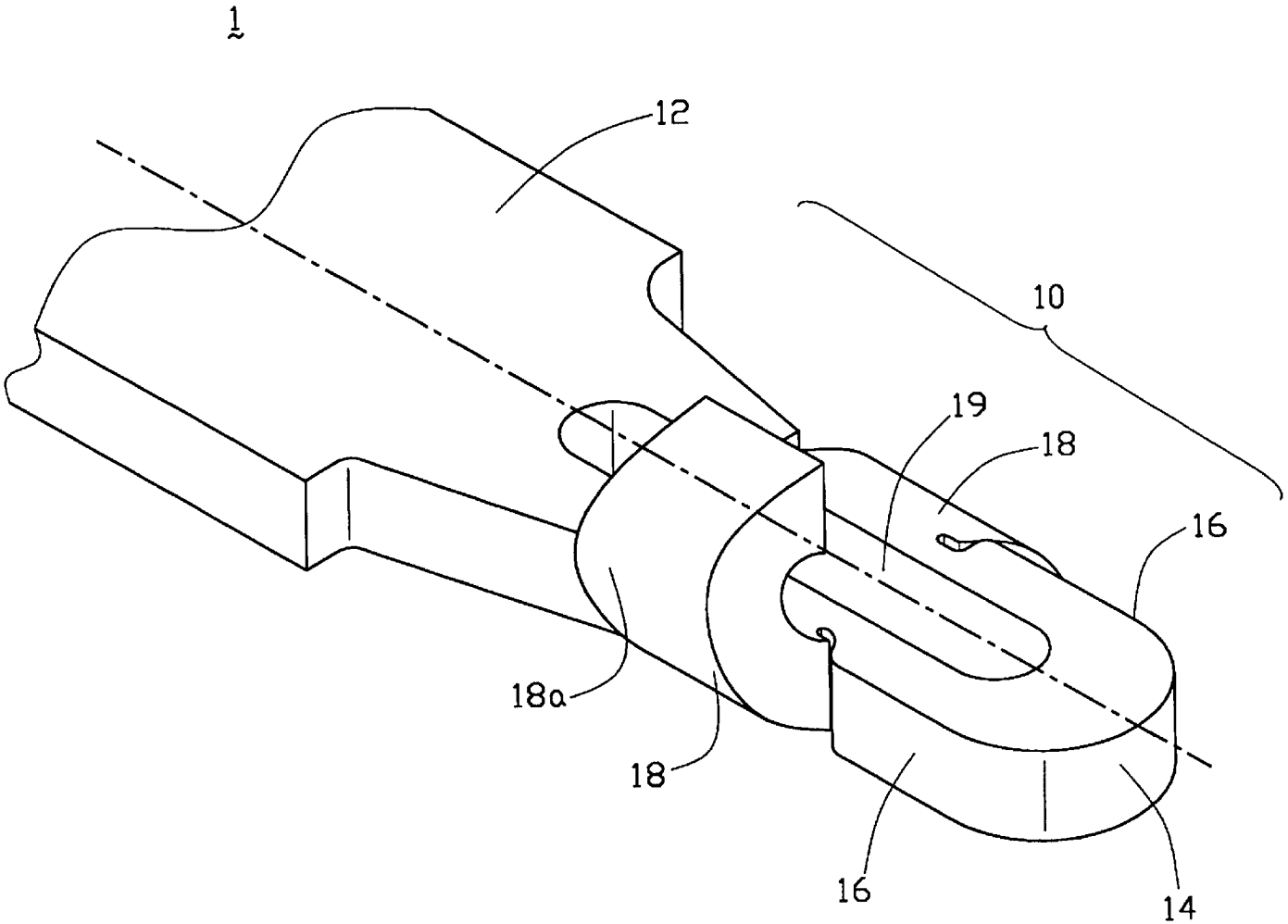
FIG. 1 is a perspective view of a board-engaging contact structure for a contact in accordance with the present invention; wherein the contact is abbreviated.
Figure 2:
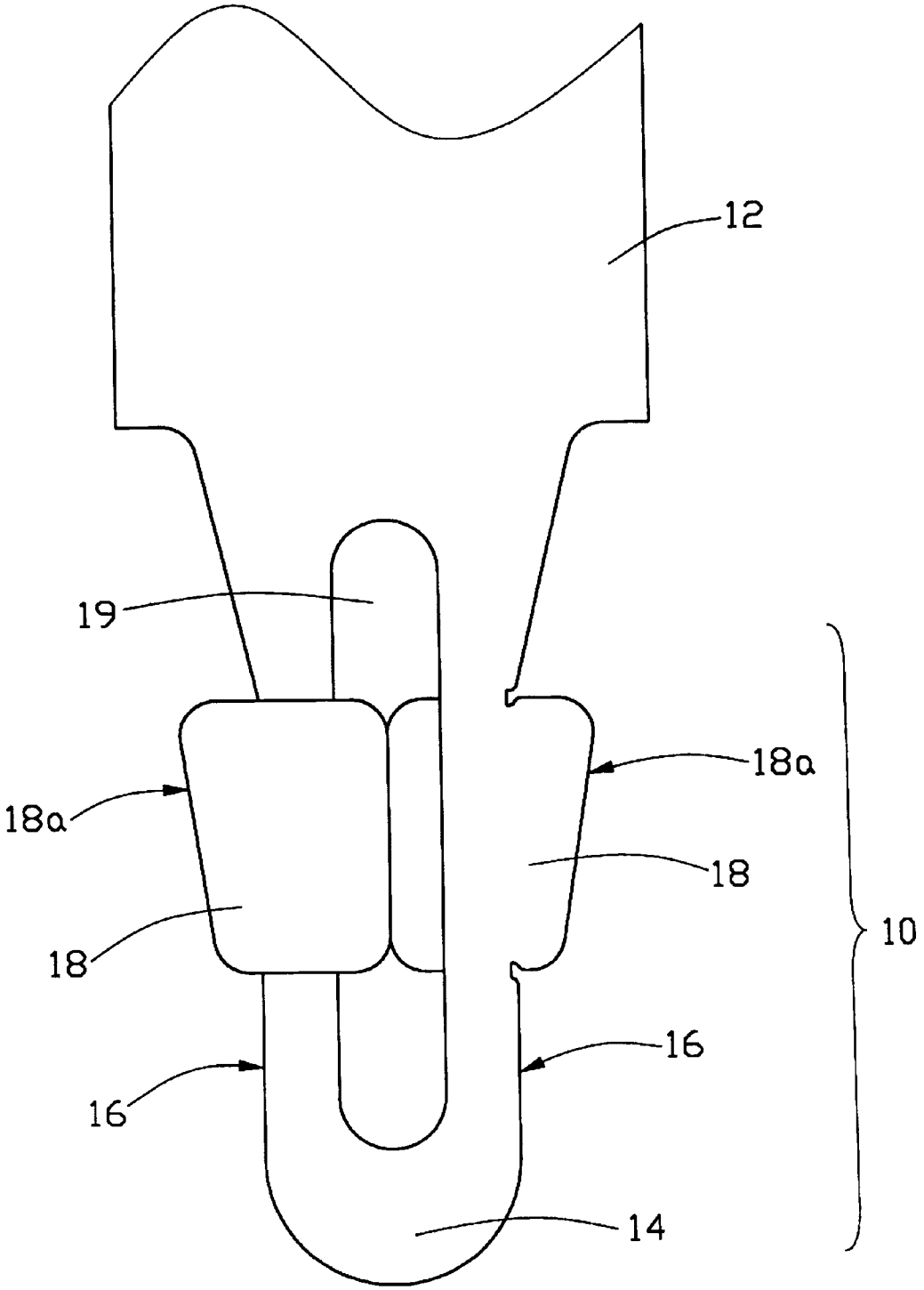
FIG. 2 is a top planer view of the contact structure of FIG. 1.
Figure 3:
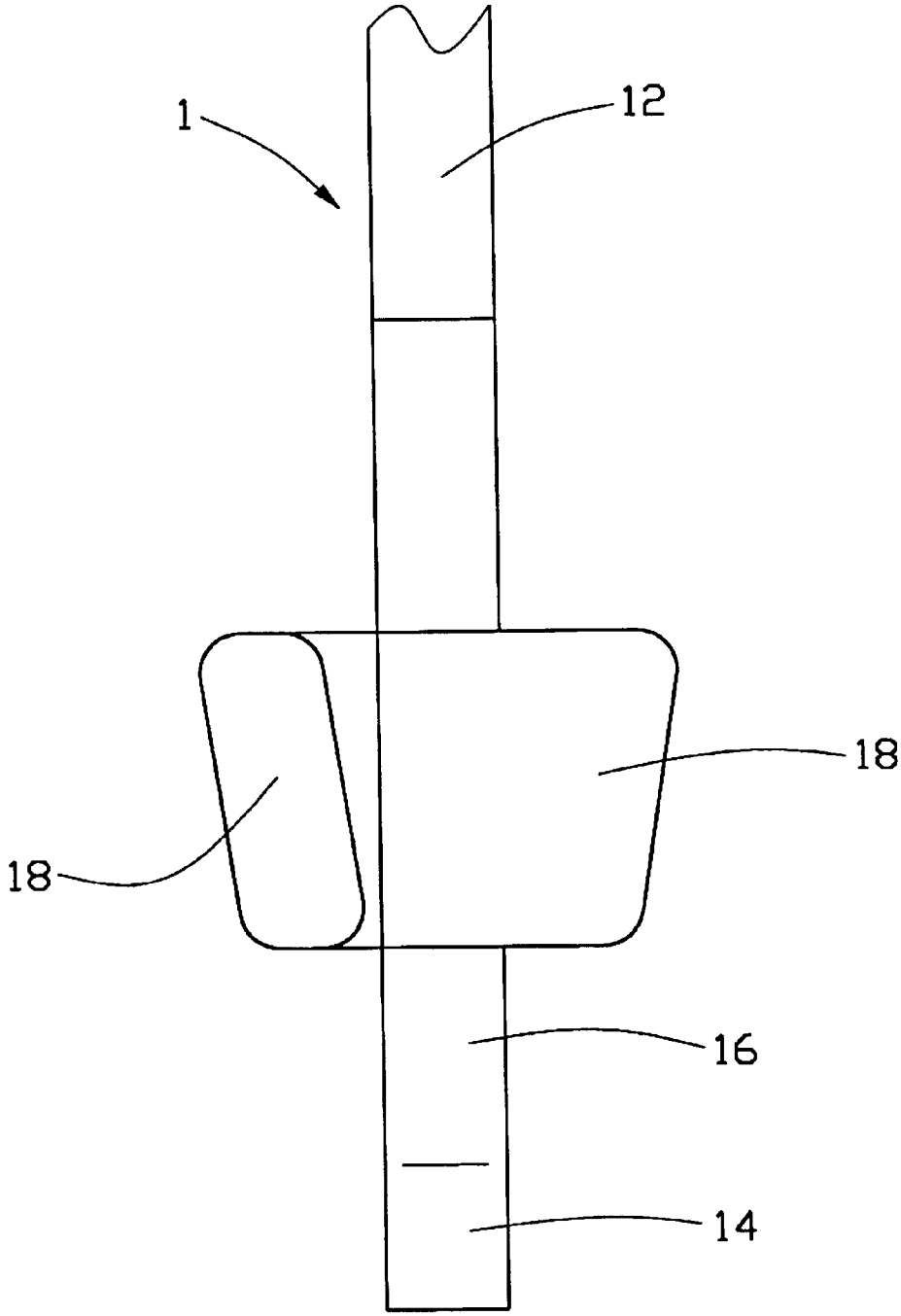
FIG. 3 is a left side view of the contact structure of FIG. 2.
Figure 4:
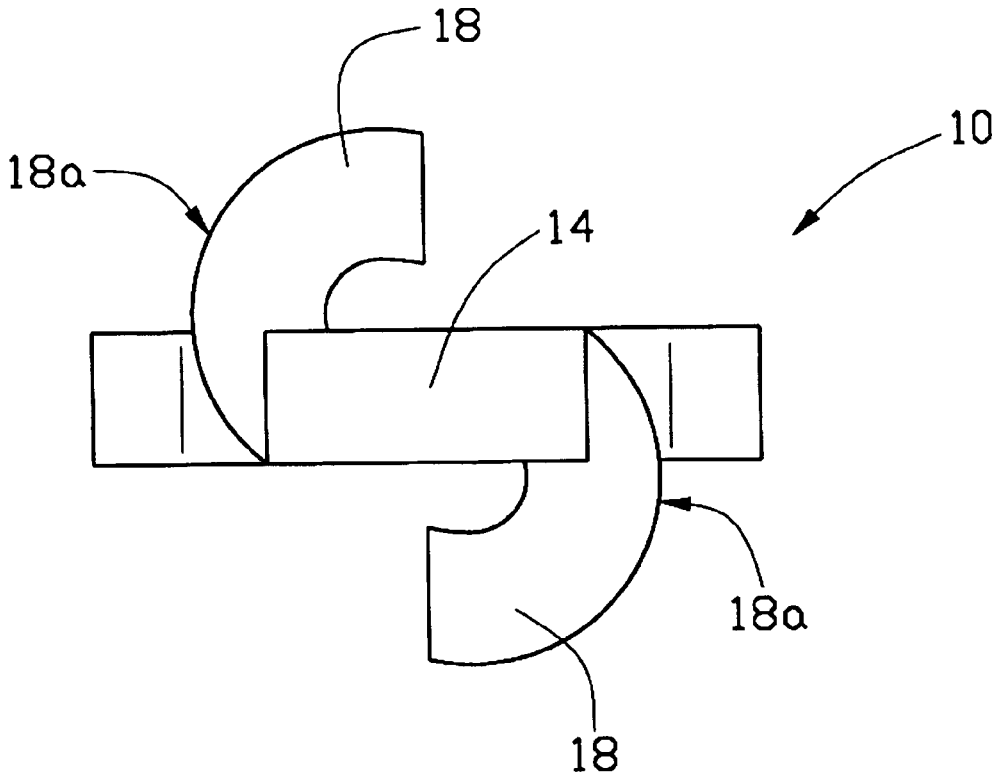
FIG. 4 is an end view of the contact structure of FIG. 1.

Referring to FIGS. 1 to 4, a contact 1 for an electrical connector (not shown) in accordance with the present invention comprises an elongate body portion 12 and a board-engaging structure 10 extending downward from a lower end of the body portion 12. The board-engaging structure 10 includes a tail portion 14 having two opposite side surfaces 16. A resilient locking arm 18 extends clockwisedly from each surface 16 of the tail portion 14. Each locking arm 18 has an outer contact surface 18*a* adapted for engaging with a corresponding inner surface 34 of a hole 32 defined in a printed circuit board (PCB) 30 (see FIG. 5). Each outer contact surface 18*a* is oblique such that an upper portion thereof extends further away from a longitudinal axis of the tail portion 14 than a lower portion thereof does. The tail portion 14 further defines a vertical elongated hole 19 in a middle portion thereof, for providing space for the tail portion 14 to elastically deform when the structure 10 is inserted into the hole 32 of the PCB 30 (see FIG. 5).

Figure 5:
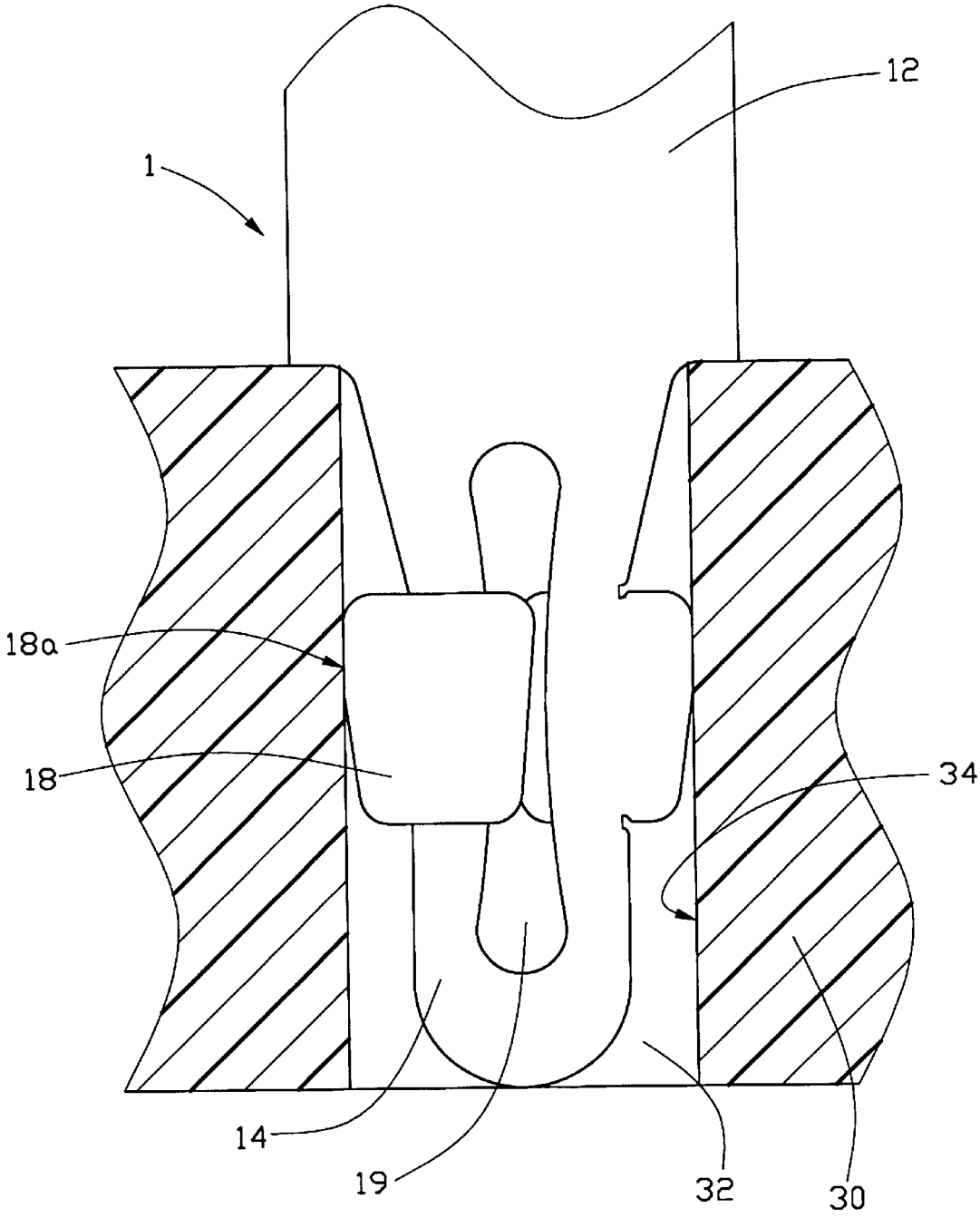
FIG. 5 is a view of the contact structure as shown in FIG. 2, now inserted into a hole of a PCB, and with the PCB shown in cross section.
Figure 6:
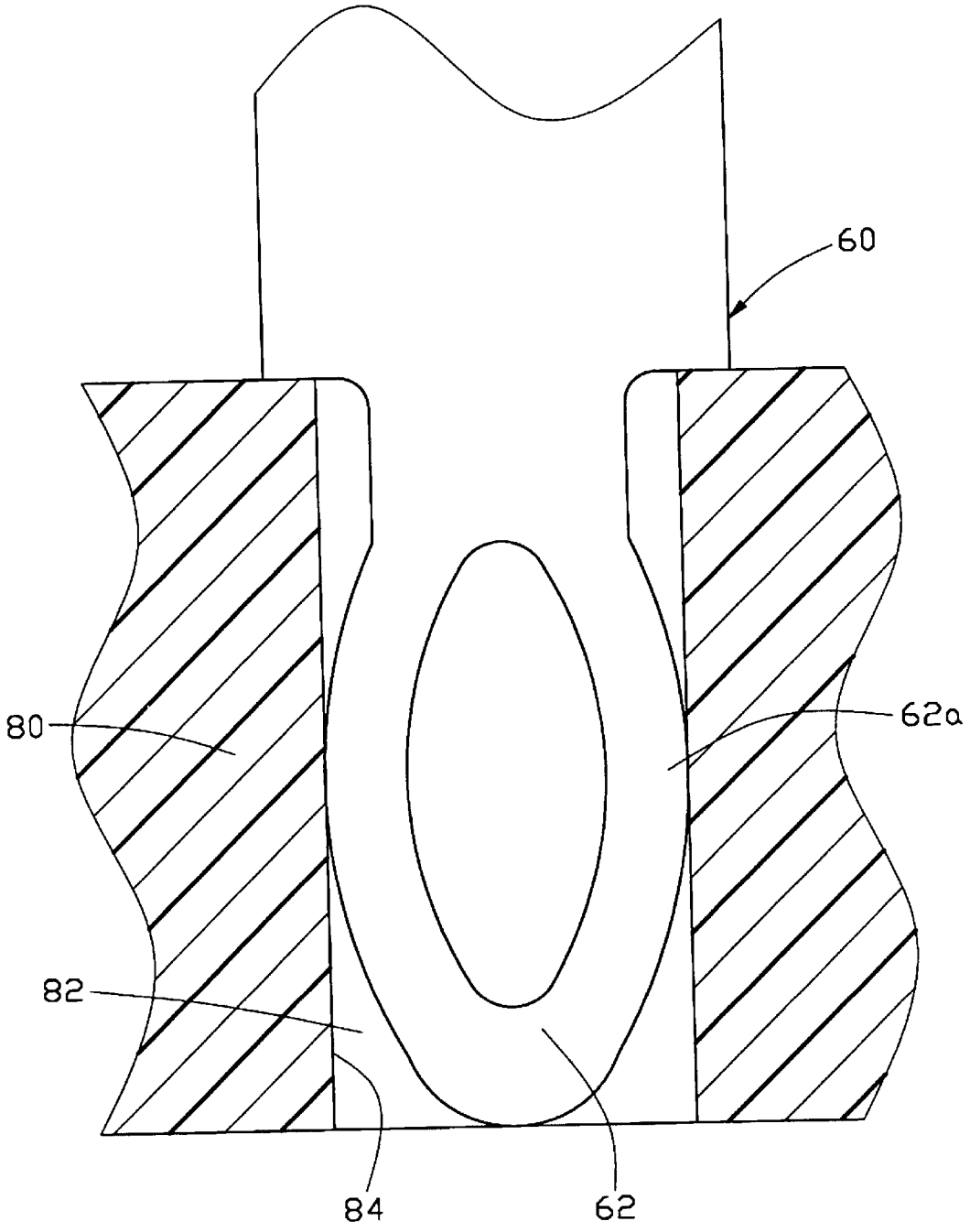
FIG. 6 (PRIOR ART)
FIG. 6 is a view of a conventional needle-eye contact structure inserted into a hole of a PCB.

Referring to FIG. 5, in use, the board-engaging structure 10 is inserted into the hole 32 of the printed circuit board 30, for securing the contact 1 to the PCB 30. During insertion, the tail portion 14 and the locking arms 18 elastically deform, and thereby firmly secure the contact 1 in the PCB 30. The contact area between each outer contact surface 18*a* and the inner surface 34 of the PCB 30 is substantially increased.

An advantage of the present invention is that the retaining force between each outer contact surface 18*a* of the board-engaging structure 10 and each inner surface 34 of the PCB 30 is increased because the contact area is face-to-face, instead of the mere point-to-face contact area provided by prior art. Thus, the contact 1 is more securely mounted to the PCB 30.

Another advantage of the present invention is that the locking arms 18 and the hole 19 together provide ample resilience, thereby enabling the board-engaging structure 10 to be easily and securely retained in the PCB 30. A further advantage of the present invention is that the oblique shape of each outer contact surface 18*a* ensures that the board-engaging structure 10 can be easily removed from the hole 32 of the PCB 30 without the need for excessive force. This minimizes any damage caused to the inner surface 34 of the PCB 30 during such removal process.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A contact structure of an electrical connector, for securing to a hole in a printed circuit board, comprising:

an elongate body portion; and a board-engaging structure extending from a lower end of the body portion, the board engaging structure comprising:

a tail portion; and two locking arms curved around the girth of the tail portion, wherein each locking arm comprises a contact surface of an outer limit thereof for engaging with a corresponding inner surface of the hole of the printed circuit board;

wherein each locking arm is elastically deformable;

wherein each locking arm has at least an oblique contact surface, such that an upper portion thereof extends further away from a longitudinal axis of the tail portion than a lower portion thereof does;

wherein the locking arms extend from two opposite lateral side surfaces of the tail portion;

wherein the two locking arms are curved clockwise;

wherein the board-engaging structure defines a hole in a middle portion thereof.

* * * * *